US009961943B2

(12) United States Patent
Klein

(10) Patent No.: US 9,961,943 B2
(45) Date of Patent: May 8, 2018

(54) ATHLETIC SOCK

(75) Inventor: Jason Klein, Orange, CT (US)

(73) Assignee: F3 TECH, LLC, Derby, CT (US)

( * ) Notice: Subject to any disclaimer, the term of this patent is extended or adjusted under 35 U.S.C. 154(b) by 560 days.

(21) Appl. No.: 12/938,447

(22) Filed: Nov. 3, 2010

(65) Prior Publication Data

US 2012/0102625 A1 May 3, 2012

(51) Int. Cl.

| | |
|---|---|
| ***A41B 11/00*** | (2006.01) |
| ***D04B 1/04*** | (2006.01) |
| ***D04B 1/26*** | (2006.01) |

(52) U.S. Cl.

CPC ..... *A41B 11/003* (2013.01); *D04B 1/04* (2013.01); *D04B 1/26* (2013.01); *A41D 2400/60* (2013.01)

(58) Field of Classification Search

CPC ..... A41B 11/12; A41B 11/102; A41B 11/005; A41B 11/02; A41B 11/04; A41B 11/003; A41D 13/0015; A41D 2400/60; A61F 13/00; A61F 13/06; A61F 13/08; D04B 1/26; D04B 1/04

USPC ..... 2/239, 272, DIG. 1, 240; 66/178 A, 66/182–187, 188, 200–202

See application file for complete search history.

(56) References Cited

U.S. PATENT DOCUMENTS

| | | | |
|---|---|---|---|
| 709,734 | A | 9/1902 | Bellis |
| 1,018,134 | A | 2/1912 | Scott |
| 1,434,941 | A | 11/1922 | Boyd |
| 2,144,563 | A | 1/1939 | Davis |
| 2,746,054 | A | 5/1956 | Heilbronner |
| 3,107,510 | A | 10/1963 | Manger |
| 3,113,570 | A | 12/1963 | Holliday et al. |
| 3,250,095 | A | 5/1966 | Bird |
| 3,259,915 | A | 7/1966 | Dison |
| 3,307,379 | A | 3/1967 | Woolley et al. |
| 3,510,882 | A | 5/1970 | White |
| 3,796,067 | A | 3/1974 | East |
| 4,047,400 | A | 9/1977 | Thorneburg |
| 4,079,602 | A | 3/1978 | Blore |
| 4,229,954 | A | 10/1980 | Blore |
| 4,267,710 | A | 5/1981 | Imamichi |
| 4,341,096 | A | 7/1982 | Safrit et al. |
| 4,571,960 | A | 2/1986 | Hursh et al. |
| 4,615,188 | A | 10/1986 | Hursh et al. |
| 4,898,007 | A | 2/1990 | Dahlgren |
| 5,033,276 | A | 7/1991 | Strauss et al. |
| 5,095,548 | A | 3/1992 | Chesebro, Jr. |
| 5,353,524 | A | 10/1994 | Brier |
| 5,511,323 | A | 4/1996 | Dahlgren |
| 5,687,587 | A | 11/1997 | Michel |
| 5,708,985 | A | 1/1998 | Ogden |
| 5,724,836 | A | 3/1998 | Green |
| 6,082,146 | A | 7/2000 | Dahlgren |
| 6,341,505 | B1 | 1/2002 | Dahlgren |
| 6,435,221 | B1 | 8/2002 | Waldrop et al. |
| 6,612,136 | B2 | 9/2003 | Roe |
| 6,708,348 | B1 | 3/2004 | Romay |
| 6,723,428 | B1 | 4/2004 | Foss et al. |

(Continued)

*Primary Examiner* — Khaled Annis

(74) *Attorney, Agent, or Firm* — John S. Child, Jr.; Paul & Paul

(57) ABSTRACT

An athletic sock formed from a yarn comprising Coolmax® polyester fibers, cotton fibers and Lycra® polyurethane-polyurea copolymer fiber. The sock has a toe portion, at least one compression portion, a heel and ankle portion, and an upper band at the top portion of the sock.

17 Claims, 4 Drawing Sheets

(56) References Cited

U.S. PATENT DOCUMENTS

| | | | | |
|---|---|---|---|---|
| 6,777,356 | B2 | 8/2004 | Sadato et al. | |
| 6,986,270 | B2 | 1/2006 | Miller, III et al. | |
| 7,069,600 | B1 | 7/2006 | Romay | |
| 7,213,420 | B2 | 5/2007 | Lynch et al. | |
| 7,552,483 | B2 | 6/2009 | Turner | |
| 7,552,603 | B2 | 6/2009 | Dahlgren | |
| 7,565,920 | B2 | 7/2009 | Li et al. | |
| 7,614,257 | B2 | 11/2009 | Araki et al. | |
| 2006/0010574 | A1 | 1/2006 | Linnane et al. | |
| 2006/0286376 | A1 | 12/2006 | Haigh et al. | |
| 2008/0041113 | A1* | 2/2008 | Mori et al. | 66/54 |
| 2008/0249454 | A1* | 10/2008 | Mills | 602/63 |

* cited by examiner

ATHLETIC SOCK

CROSS-REFERENCE TO RELATED APPLICATIONS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION (1) Field of the Invention

The invention relates to an athletic sock having improved abrasion resistance, comfort and moisture management, and being formed from a yarn comprising a combination of cotton, Coolmax® and Lycra® elastane.

(2) Description of Related Art, Including Information Disclosed Under 37 C.F.R. Sections 1.97 and 1.98.

There is a growing interest today in an athletic sock that is durable, comfortable, and easy to manufacture. The durability of a sock can be measured by its abrasion resistance. The comfort of a sock can be evaluated by its ability to manage moisture building up on the wearer's foot during physical activity. The comfort level can be evaluated by the comfort level of the wearer's feet resulting from wearing the sock during physical activity.

In order to overcome the problems resulting from uncomfortable wetness, a sock has been developed having portions or zones comprising different types of fibers. For example, U.S. Pat. No. 6,341,505 to Dahlgren discloses a moisture management sock with portions or zones constructed predominantly with hydrophobic yarn with rings of hydrophobic yarn and rings of hydrophilic yarn.

Sock durability depends upon the resistance of the sock to wear or abrasion. An athletic sock which can undergo great stress during use requires excellent wear qualities.

Sock comfort is another important objective. Comfort is a product of several factors. An athletic sock should be able to manage moisture resulting from the physical activity of the sock wearer and avoid retention of heat resulting from the moisture formation. The sock should also contact the foot and leg in a manner that avoids any form of abrasion to the skin. The sock should also remain in place when worn, rather than shifting in position.

BRIEF SUMMARY OF THE INVENTION

An object of the invention is an athletic sock with improved abrasion resistance.

Another object of the invention is an athletic sock with improved ability to repel moisture buildup.

A further object of the invention is an athletic sock that has increased comfort.

An additional object of the invention is a sock formed from a single combination of yarn.

The athletic sock of the present invention is knit from a yarn formed by combining filaments of Coolmax®, cotton and Lycra® fibers. Coolmax® is a mark of Invista North America S.A.R.L. of Wilmington, Del., for four-channel polyester fibers that are formed together in cross-sections to allow air to flow through the fabric. Lycra®, also known as spandex or elastane, is also a mark of Invista for a lightweight, stretchy fiber formed from a polyurethane-polyurea copolymer.

The sock has a toe portion, a compression portion, a heel and ankle portion and an upper band at the top portion of the sock. In another embodiment the athletic sock has a second compression portion at the ankle.

DETAILED DESCRIPTION OF THE INVENTION

In a preferred embodiment, the athletic sock of the invention comprises 35-75% Coolmax® yarn fibers, 15-35% cotton yarn fibers and 10-30% Lycra® yarn fibers. In a particularly preferred embodiment, the athletic sock of the invention comprises 55% Coolmax® yarn fibers, 25% cotton yarn fibers and 20% Lycra® yarn fibers.

Figure 1:
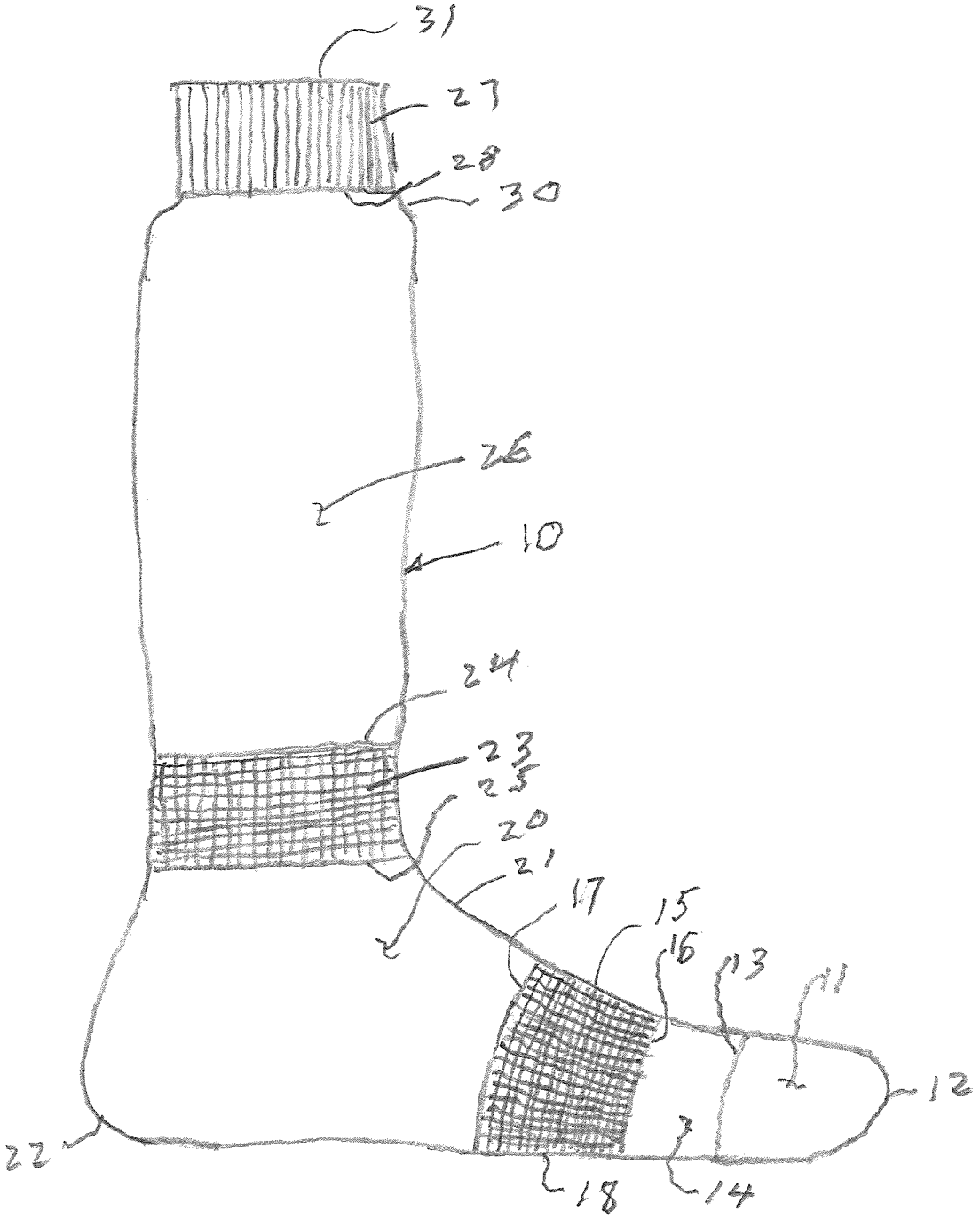
FIG. 1 is a side elevational view showing an athletic sock embodying the invention.
Figure 2:
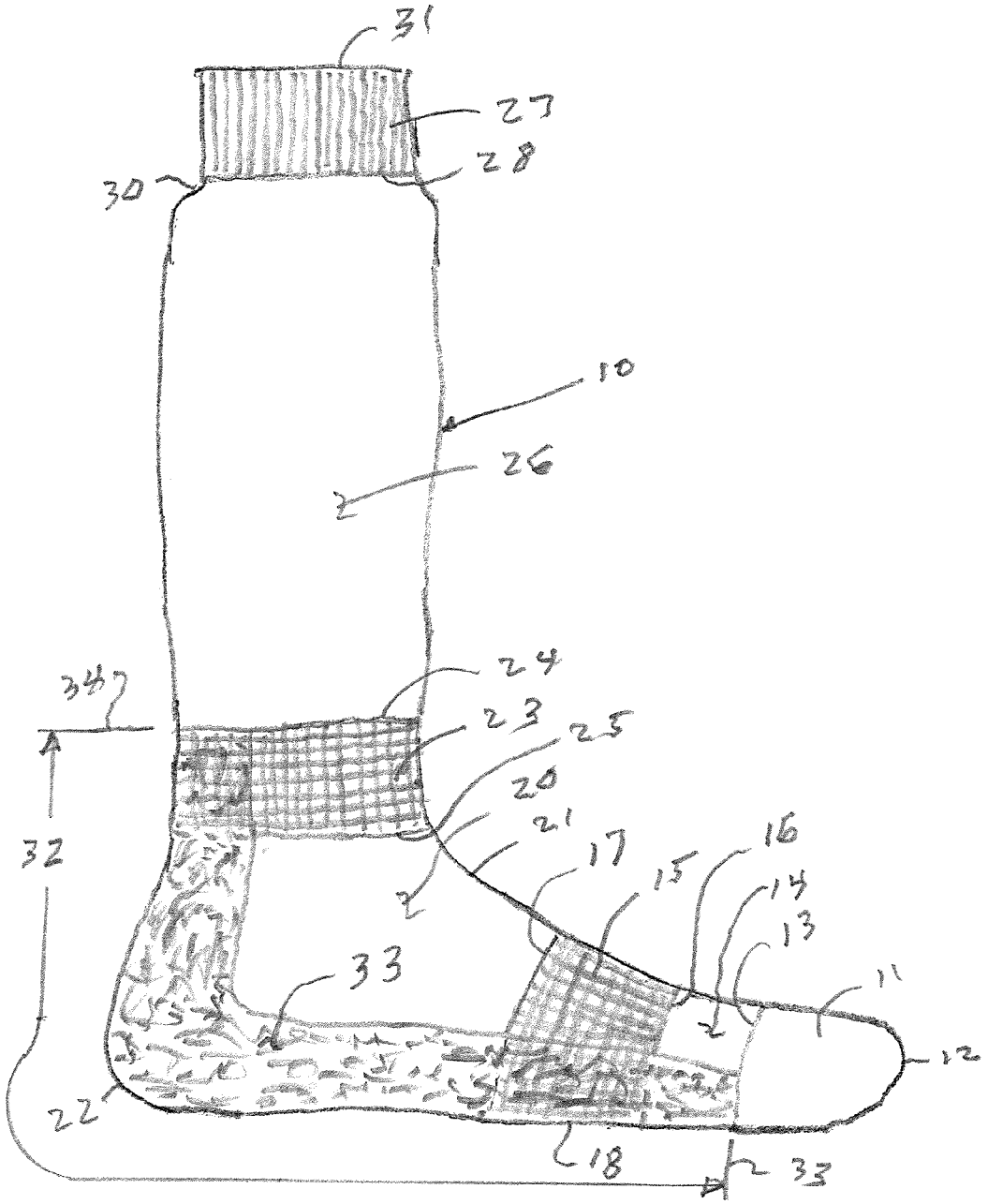
FIG. 2 is a side elevational view of the sock of FIG. 1, turned inside out.

Referring to FIGS. 1 and 2, there is shown at the numeral 10, a sock made in accordance with the present invention.

The sock 10 of FIGS. 1 and 2 includes a toe portion 11 going from the right end 12, to the line 13, adjacent to which is a portion 14, to the left of toe portion 11, between the toe portion 11 and a compression zone 15. The compression zone 15 is in the form of a band around the circumference of the sock, having a width as shown, between band ends 16 and 17 that is continuous around the foot area of the sock 10, even beneath the foot area 18 and beneath the foot of a wearer, provides comfort beneath the flexor hallucis longus tendon. To the left of the continuous band 15, there is an ankle portion 20 that is likewise continuous around the sock, on both sides of the sock between the instep portion 21 and the heel 22, as shown. Another continuous band 23 is disposed between its ends 24 and 25, with the end 25 adjacent the ankle portion 20, and likewise being continuous circumferentially around the sock 10. Above the band 23, there is a calf portion 26 of the sock, that is likewise continuous circumferentially around the sock 10. At the upper end of the calf portion 26, there is a band 27, between lower and upper ends 28, 31, of reduced diameter relative to the calf portion 26, as shown, at 30, with the band portion 27 being sufficiently elastic to snuggly engage that portion of the leg of a user that is inside the band 27.

With specific reference to FIG. 2, it will be seen that when the sock 10 is viewed in an inside-out condition, there is a terry zone 33 extending from the line 13 to the line 24 as shown by the double headed arrow line 32 extending between lines 33 and 34, that correspond to drafting extensions of the lines 13 and 24. The terry zone 33 appears on both sides of the sock 10, with the opposite side of the sock 10 being a mirror image of FIG. 2, and when the sock is worn, is beneath the plantar region of the foot and behind the ankle.

The sock 10, including its various portions described above, is constructed as a triple knit fabric. One example of such a triple knit fabric is set forth in U.S. Pat. No. 5,033,276, the complete disclosure of which is herein incorporated by reference. An example of a terry knit is disclosed in U.S. Pat. No. 2,144,563, the complete disclosure of which is herein incorporated by reference, as well.

The bands 15, 23 and 27 extend over the entire circumference of the sock, as shown and are known as compression zones that provide for the wearer of the sock, a level of comfort not present in conventional athletic socks.

The compression zones or bands create space between the inner ply and the foot. The result is that the wearer of the sock of the invention is more comfortable than the wearer of a conventional athletic sock.

The use of a combination of Coolmax®, cotton and Lycra® yarn fibers in the sock results in more efficient wicking of moisture from the athletic sock of the invention than is obtained in a conventional athletic sock formed from other yarn fibers. The athletic sock according to the invention being knit from a combination of Coolmax®, cotton and Lycra® yarn fibers, also has an extraordinary resistance to abrasion that is far superior to socks woven from a combination of two of these yarn fibers.

Figure 3:
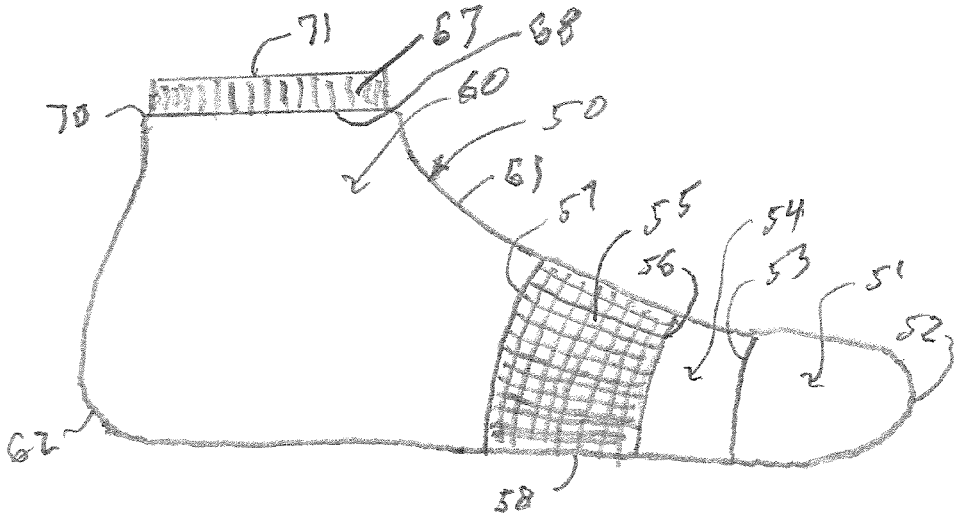
FIG. 3 is a side elevational view showing a second athletic sock embodying the invention.
Figure 4:
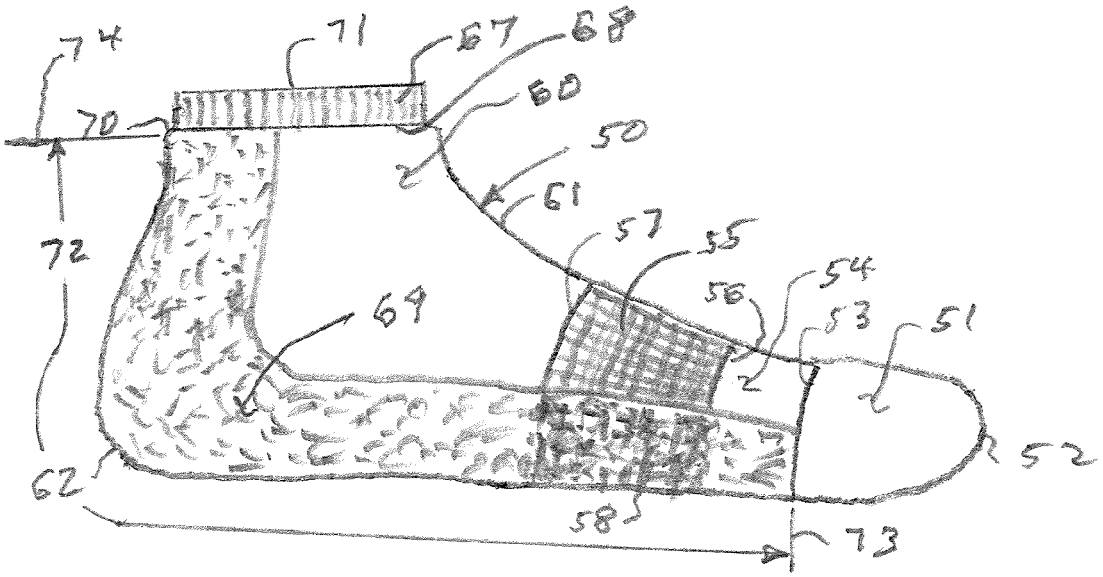
FIG. 4 is a side elevational view of the sock of FIG. 3, turned inside out.

Referring now to FIGS. 3 and 4, it will be seen that a different embodiment of an athletic sock 50 is presented, in the form of an ankle sock. In general, the sock of FIGS. 3 and 4 is constructed in much the same manner as the sock 10 of FIGS. 1 and 2, except that the sock of FIGS. 3 and 4 does not have a compression band above the ankle portion 60 of the sock, other than the elastic band 67. The sock 50 of FIGS. 3 and 4 thus has a toe portion 51 extending from the right end 52 thereof, to the line 53, adjacent to which is a portion 54 extending between the line 53 and one end 56 of the band 55, with the band extending between the ends 56 and 57, and with the band 55 extending around the complete circumference of the sock, from the top 61 to the bottom 58, with the opposite sides of the sock 50 from that illustrated in FIGS. 3 and 4 being mirror images of FIGS. 3 and 4. The circumferential band 55 beneath the foot of a wearer is beneath the flexor hallucis longis tendon. An ankle portion 60 of the sock extends between the end 57 of the band 55, up to the end 68 of the band 67, with the band 67 extending from the upper end 71 of the sock, down to the band end 68, with the band 67 being of reduced diameter for snuggly engaging above the ankle of the wearer, such reduced diameter portion being shown at 70. The band 67 likewise extends completely around the circumference of the ankle of the wearer.

Figure 5:
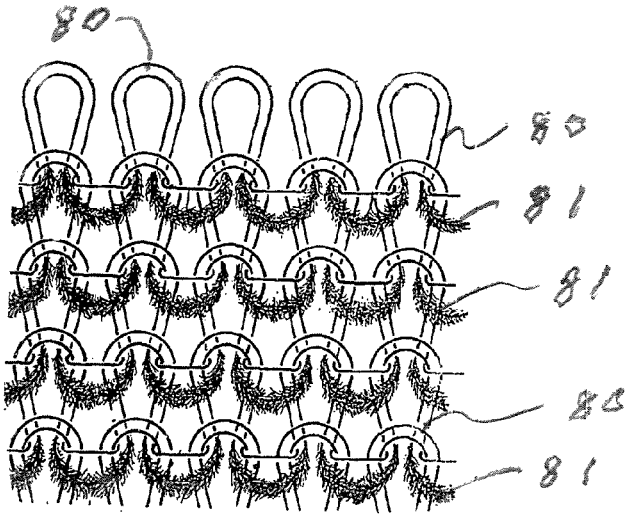
FIG. 5 is a fragmentary view of a fabric made of three-component yarn fibers, in accordance with this invention, with the yarn having been brushed and wherein fibers of adjacent yarn loops can commingle to yield a soft, plush effect, for comfort to the wearer of the sock.

A terry portion 69 of the sock extends from line 53 to line 68, as shown by the double headed arrow 72 extending between extension lines 73 and 74, with the terry portion 69 likewise being on both sides of the sock 50 and around the heel portion 62, such that a mirror image of the illustration of FIG. 4 would likewise have a terry portion similar to that 69. In FIG. 5, a fragmentary illustration of a fabric comprised of yarns 80 is illustrated, wherein the yarns 80 are, in turn, comprised of a plurality of filaments of the three above-mentioned fibers, and wherein the yarn loops are illustrated as being of brushed terry, wherein fibers 81 of adjacent loops, being abraded in the brushing operation, can be partially pulled out of the yarns, enabling them to co-mingle, to yield a soft, plush effect for the terry portion 33 or 69, of the socks of this invention, for additional comfort. Alternatively, the fabric of FIG. 5 could be unbrushed, as may be desired.

The bands 55, 67, likewise function as compression zones, providing the wearer of the sock greater comfort than would be provided to the wearer of a conventional athletic sock.

The compression zones 27, 67 of the socks of the embodiments of FIGS. 1-4 are stretchable, resulting in a tighter hold of the socks on the legs of wearers, than would be for a conventional sock.

While, as described above, the socks of the embodiments of this invention are comprised of yarn that by weight is of 35%-75% Coolmax (polyester fiber), 15%-35% cotton fiber, and 10%-30% lycra (polyurethane-polyuera copolymer) fiber, in the compression zones 15, 23, 27 and 55, 67, those ranges would be yarn that by weight is of 32%±25% Coolmax fiber, 16%±25% cotton fiber and 52%±25% lycra fiber (elastane), due to the increased elastic present in those particular zones. In a preferred embodiment, in the compression zones 15, 23, 27, 55 and 67 the socks will be comprised of yarn that, by weight, is about 32% Coolmax fiber, about 16% cotton fiber and about 52% lycra fiber. The remainder of the non-band portions of the sock is comprised of 35%-75% polyester fiber, 15%-35% cotton fiber and 10%-30% polyurethane-polyurea copolymer fiber. In a preferred embodiment the remainder of the sock consists essentially of about 55% polyester fiber, about 25% cotton fiber, and about 20% polyurethane-polyurea copolymer fiber. In a particularly preferred embodiment, the remainder of the sock is consists of about 55% polyester fiber, about 25% cotton fiber, and about 20% polyurethane-polyurea copolymer fiber.

The abrasion resistance, comfort and moisture management advantages of the athletic socks of the invention are particularly advantageous for wearers of the socks for an extended period of time. Such wearers include athletes in professional events or events of long duration such as golf. Other wearers would include persons who otherwise participate in athletic events including officials such as baseball umpires and referees of other sports.

Reference is also made to the following U.S. patent documents, the complete disclosures of which are herein incorporated by reference:

U.S. Pat. No. 5,687,587

U.S. Pat. No. 709,734

U.S. Pat. No. 4,267,710

U.S. Pat. No. 4,079,602

U.S. Pat. No. 4,229,954

U.S. Pat. No. 5,708,985

U.S. Pat. No. 6,341,505

U.S. Pat. No. 7,213,420

2006/0010574

2006/0286376

Having generally described this invention, a further understanding can be obtained by reference to certain specific examples which are provided herein for purposes of illustration only and are not intended to be limiting unless otherwise specified

EXAMPLES

Example 1

Comparative Test of Abrasion Resistance

The abrasion resistance study characterizes a sock made according to the invention and a comparative sock. The sock made according to the invention was knitted from a yarn comprising 55% CoolMax®, 25% cotton, and 20% Lycra® (elastane) fibers. The comparative sock was knitted from a yarn consisting of cotton and Lycra® (elastane) fibers.

A Martindale abrasion tester, described in ASTM-4966-98 and in U.S. Pat. No. 6,435,221, the complete disclosure of which is herein incorporated by reference, was used. A circular disc of fabric from the sock made according to the invention was mounted on the side of the sample holder and the front side of the inventive fabric (the surface on the fabric from the outer side of the sock) was rubbed with the referenced wool fabric under a load of 12 kPa. After being rubbed 150,000 times, the fabric was intact.

A circular disc of fabric taken from the comparative sock underwent the same abrasion resistance test described directly above. The disc broke down after being rubbed less than 100,000 times.

These results demonstrate the unexpectedly superior abrasion resistance of socks comprising the three fiber composition of the invention relating to socks made from fibers containing two of the three fibers of the invention.

Example 2

Comparative Test of Sock Comfort

A pair of socks according to the invention made from yarn comprising 55% CoolMax®, 25% cotton, and 20% Lycra® (elastane) fibers and a pair of socks of the same size and appearance knit from yarn comprising fibers of cotton and Lycra® (elastane) are each worn for 15 minutes by 13 test subjects.

The socks were not identified to the wearers as socks made or not made according to the invention to ensure that the test is a blind test. Instead the sock should be marked as Sock A and Sock B.

After wearing one of the pairs of socks, the wearer is asked to evaluate the comfort of the socks and each portion of the sock on a scale of 1 (uncomfortable) to 5 (extremely comfortable).

Sock A represents the sock knit from the composition of yarn made according to the invention. (55% CoolMax®, 25% cotton, and 20% Lycra® (elastane) fibers). Sock B was knit from a combination of cotton and Lycra® yarns.

The results of the evaluations by 13 test subjects, identified by initials, are set forth in the chart marked as Table 1.

TABLE 1

| | DC | AG | KE | TT | BA | WB | TL | DS | JB | TC | DT | MK | DM | Median | Mode | Average |
|---|---|---|---|---|---|---|---|---|---|---|---|---|---|---|---|---|
| Sock A | | | | | | | | | | | | | | | | |
| Overall Comfort | 5 | N/A | N/A | 5 | 5 | 4 | 4 | 5 | 4 | 5 | N/A | 4 | 5 | 5 | 5 | 4.60 |
| Fabric | 5 | 5 | 5 | 5 | 5 | 4 | 5 | 4 | 5 | 5 | 5 | 4 | 5 | 5 | 5 | 4.77 |
| Elastic Band at the Top | 5 | 5 | 4 | 5 | 5 | 5 | 5 | 5 | 4 | 5 | 4 | 4 | 5 | 5 | 5 | 4.69 |
| Toe Seam | 5 | 5 | 5 | 5 | 5 | 4 | 5 | 5 | 4 | 3 | 4 | 4 | 4 | 5 | 5 | 4.46 |
| Heal Pocket | 5 | 5 | 5 | 5 | 5 | 5 | 5 | 5 | 4 | 4 | 4 | 4 | 5 | 5 | 5 | 4.69 |
| Sock B | | | | | | | | | | | | | | | | |
| Overall Comfort | 3 | N/A | N/A | 4 | 3 | N/A | N/A | 5 | N/A | 3 | N/A | 3 | 0 | 3 | 3 | 3.00 |
| Fabric | 4 | 3 | 3 | 3 | 3 | 2 | 3 | 4 | N/A | 3 | 3 | 4 | 0 | 3 | 3 | 2.92 |
| Elastic Band at the Top | 5 | 3 | 2 | 4 | 3 | 2 | 4 | 5 | N/A | 3 | 3 | 2 | 2 | 3 | 3 | 3.17 |
| Toe Seam | 3 | 2 | 3 | 4 | 3 | 2 | 4 | 5 | N/A | 2 | 2 | 3 | 1 | 3 | 3 | 2.83 |
| Heal Pocket | 3 | 2 | 3 | 5 | 3 | 2 | 4 | 5 | N/A | 3 | 2 | 2 | 1 | 3 | 3 | 2.92 |

The evaluations of the 13 wearers of socks A and B demonstrate that the comfort of Sock A (made according to the invention) is greater in the whole sock and in each portion of the sock. Hence, the comfort of the sock made according to the invention is unexpectedly and substantially superior to socks made from compositions of yarn relatively similar to the inventive composition.

The invention claimed is:

1. An athletic abrasion resistant and comfortable athletic sock for covering the foot of a wearer and comprising a triple knit construction and having a continuous first compression zone in the form of a band around the circumference of the sock, located rearward of a toe portion of the sock and forward of an ankle of the sock, with a bottom portion of the compression band adapted to the foot of a wearer; with an elastic band neck portion of the sock being at an upper end of the sock and sufficiently elastic to engage the leg of a wearer above an ankle portion of the sock, said neck portion being continuous around the circumference of the sock with the band and non-band portions of the sock being comprised of yarn that by weight is of 35% to 75% polyester fiber, 15% to 35% cotton fiber and 10% to 30% polyurethane-polyurea copolymer fiber.

2. The sock of claim 1, wherein said remainder of the sock consists essentially of three-component yarn that by weight is of about 55% polyester fiber, about 25% cotton fiber, and about 20% polyurethane-polyurea copolymer fiber.

3. The sock of claim 1, wherein the sock covering the foot of the wearer is adapted to the foot and wherein the bottom portion of the sock that is adapted to be disposed beneath the plantar region of the foot and behind the ankle of the wearer, is of terry yarn.

4. The sock of claim 1, wherein the sock covering the foot of the wearer is adapted to the foot and wherein the bottom portion of the sock that is beneath the foot and behind the ankle of the wearer, is of terry yarn.

5. The sock of claim 1, wherein the percentage by weight of the first compression band and said neck portion consists essentially of three-component yarn that is 32% Coolmax fiber, 16% cotton fiber and 52% polyurethane-polyurea copolymer fiber.

6. The sock of claim 1, wherein a portion of the sock remains intact after being rubbed 150,000 times with a wool fabric under a load of 12 KPa.

7. The sock of claim 1, wherein the sock is regarded as extremely comfortable at the compression band and toe portions.

8. An athletic abrasion-resistant and comfortable athletic sock for covering the foot of a wearer, comprising a triple knit construction and being comprised of three-component yarn comprising a combination of polyester fiber, cotton fiber and polyurethane-polyurea copolymer fiber.

9. The sock of claim 8, wherein the sock covering the foot of a wearer has a continuous first compression zone in the form of a band around the circumference of the sock located rearward of a toe portion of the sock and forward of an ankle of the sock with a bottom portion of the compression band adapted to be disposed the foot of a wearer and a second compression band which extends around the circumference of the sock above the ankle portion of the sock.

10. The sock of claim 8, wherein the sock covering the foot of the wearer includes coverage of the plantar region of the foot, and wherein the bottom portion of the sock that is adapted to be disposed beneath the foot and behind the ankle of the wearer is of terry yarn.

11. The sock of claim 10, wherein the sock covering the foot of a wearer has a continuous first compression zone in the form of a band around the circumference of the sock located rearward of a toe portion of the sock and forward of an ankle of the sock with a bottom portion of the compression band adapted to be disposed beneath the foot of a wearer and a second compression band which extends around the circumference of the sock above the ankle portion of the sock.

12. The sock of claim 8, wherein a portion of the sock remains intact after being rubbed 150,000 times with a wool fabric under a load of 12 KPa.

13. The sock of claim 8, wherein the sock is regarded as extremely comfortable at the compression band and toe portions.

14. An athletic abrasion-resistant and comfortable athletic sock for covering the foot of a wearer and comprising a triple knit construction and having a continuous first compression zone in the form of a band around the circumference of the sock, located rearward of a toe portion of the sock and forward of an ankle of the sock, with a bottom portion of the compression band adapted to be disposed beneath the foot of a wearer; said first compression band being comprised of three-component yarn consisting of 24% to 40% polyester fiber, 12% to 20% cotton fiber and 39% to 65% polyurethane-polyurea fiber, with non-band portions of the sock comprising of yarn that by weight is of 55% polyester fiber, 25% cotton fiber and 20% polyurethane-polyurea copolymer fiber.

15. The sock of claim 14, wherein the sock covering the foot of a wearer has the continuous first compression band around the circumference of the sock located rearward of a toe portion of the sock and forward of an ankle of the sock with a bottom portion of the compression band adapted to be disposed beneath the foot of a wearer and a second compression band which extends around the circumference of the sock above the ankle portion of the sock.

16. The sock of claim 14, wherein the sock covering the foot of the wearer includes coverage of the plantar region of the foot, and wherein the portion of the sock that is adapted to be disposed beneath the plantar region of the foot and behind the ankle of the wearer is of terry yarn.

17. The sock of claim 14, wherein a portion of the sock remains intact after being rubbed 150,000 times with a wool fabric under a load of 12 KPa.

* * * * *